US005188357A

United States Patent [19]

Barnum

[11] Patent Number: 5,188,357

[45] Date of Patent: Feb. 23, 1993

[54] PITCHING RUBBER

[76] Inventor: Stephen J. Barnum, 925 Patriot, Hoffman Estates, Ill. 60195

[21] Appl. No.: 787,001

[22] Filed: Nov. 4, 1991

[51] Int. Cl.[5] ..... A63B 71/00

[52] U.S. Cl. ..... 273/25

[58] Field of Search ..... 273/25, 26 R, 183 A, 273/187 B, 188 A, 195 R, 196, 195 A, 195 B; 52/102, 103; 47/29; 264/27, 33, 32; 425/232, 234; D21/199

[56] References Cited

U.S. PATENT DOCUMENTS

| | | | |
|---|---|---|---|
| D. 315,382 | 3/1991 | Ragsdale | D21/199 |
| 3,236,520 | 2/1966 | Friedman | 273/25 |
| 3,479,028 | 11/1969 | Geodes | 273/25 |
| 3,703,285 | 11/1972 | Perry | 273/25 |
| 3,837,646 | 9/1974 | Geodes | 273/25 |
| 3,863,387 | 2/1975 | Webster et al. | 47/29 |
| 3,869,128 | 3/1975 | Ohashi | 273/195 A |
| 4,306,718 | 12/1981 | Geodes | 273/25 |
| 4,531,733 | 7/1985 | Hall | 273/25 |
| 4,561,653 | 12/1985 | Wright | 273/25 |
| 4,666,155 | 5/1987 | Stille | 273/25 |
| 4,749,223 | 6/1988 | Geoders | 273/25 |
| 4,779,796 | 10/1988 | Lai | 273/195 B |
| 4,810,560 | 3/1989 | Sell | 273/26 R |
| 4,925,186 | 5/1990 | Stevenson | 273/25 |

*Primary Examiner*—Theatrice Brown
*Attorney, Agent, or Firm*—Kajane McNanus

[57] ABSTRACT

The pitching rubber comprises a block of hard rubber having a lateral flange at each longitudinal end thereof. Each flange is secured to the block of rubber and has a section which extends outwardly therefrom in a manner to lie against a surface underlying the rubber block. Each flange has a bore therein for receiving a spike therethrough, the spike being pounded into the ground to secure the pitching rubber in place. To remove the pitching rubber, the spikes are simply pried out of the ground in known manner.

18 Claims, 1 Drawing Sheet

PITCHING RUBBER

BACKGROUND OF THE INVENTION

The present invention relates to an improved pitching rubber and more particularly to a pitching rubber which can be conveniently moved and replaced.

PRIOR ART

Heretofore, pitching rubbers have been rigidly secured in place and have caused significant labor in relocating same.

This is especially true in little league play where the team coaches or the league itself usually provide the pitching rubber for a game and then remove same to take it to their next game.

It will also be understood that a pitching rubber for use by children is not positioned in the same manner as that for an adult, and is also positioned differently within age group categories for children, with relation to home base.

Various pitching mound and pad structures are disclosed in U.S. Pat. Nos. 4,063,729; 4,561,653; 4,591,154; 4,666,155; and 4,976,430. These are all complex structures and do not appear to be easily movable.

As will be described in greater detail hereinafter, the pitching rubber of the present invention is provided for use by adults as well as children and is easily movable from place to place or field to field without compromising secure positioning thereof.

SUMMARY OF THE INVENTION

A primary object of the present invention is to provide a pitching rubber which is easily movable without compromising secure positioning thereof.

A further object of the present invention is to provide a pitching rubber for use by adults as well as by children.

These objects and others as may become apparent hereinafter are specifically met in a pitching rubber comprising a rubber body molded around two metal end flanges which extend laterally outwardly of the rubber body and are adapted to be engaged to an underlying surface by means of spikes extending therethrough.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENT

Figure 1:
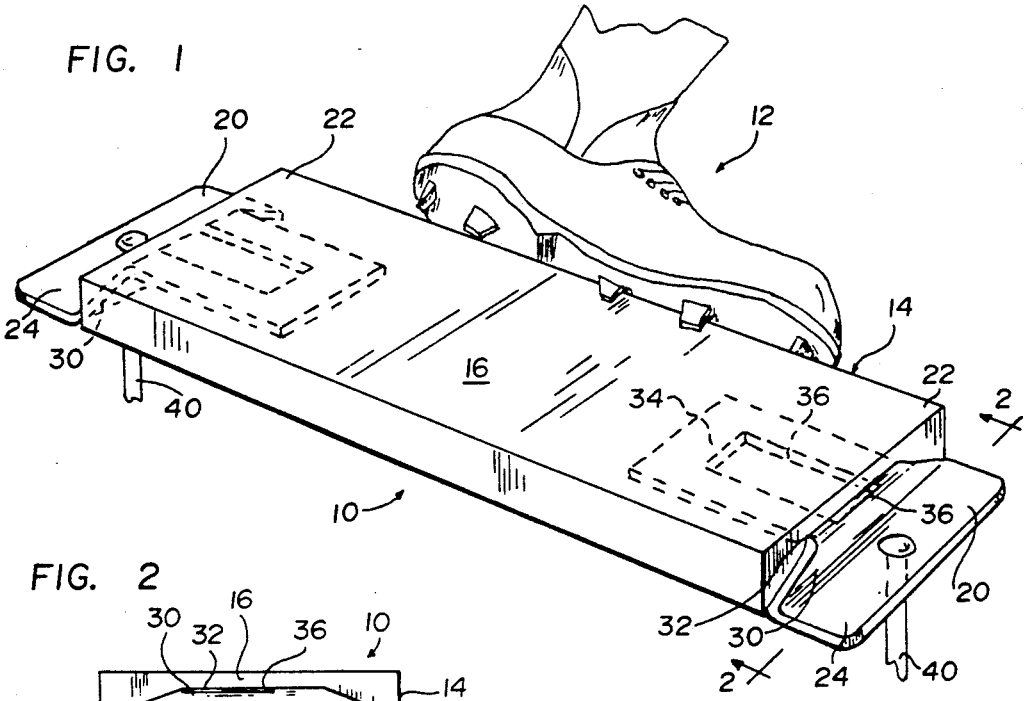
FIG. 1 is a perspective view of the pitching rubber of the present invention and shows same in use.
Figure 2:
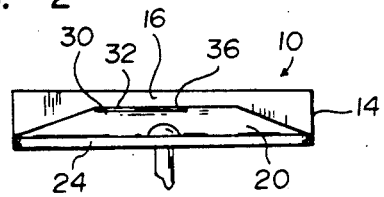
FIG. 2 is an end view of the pitching rubber and is taken along line 2—2 of FIG. 1.
Figure 3:
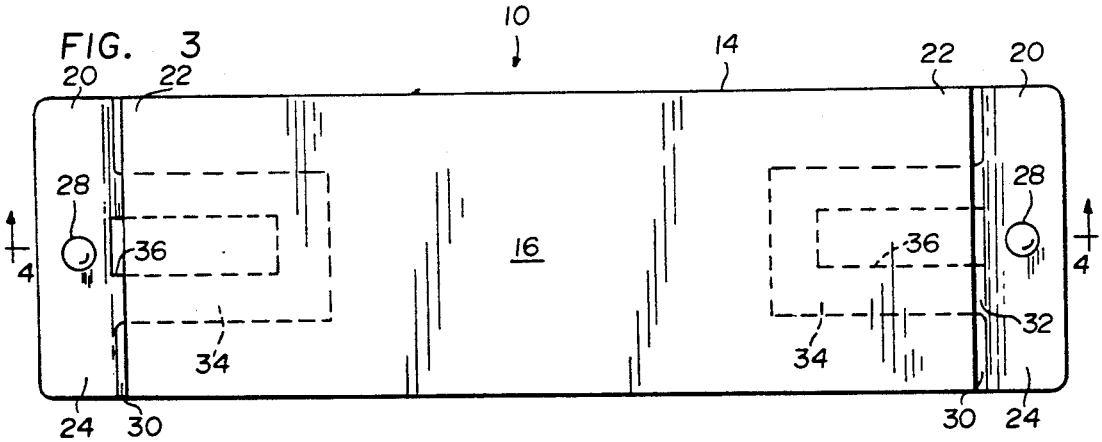
FIG. 3 is a top plan view of the pitching rubber of FIG. 1 showing a section of each end flange thereof embedded in the rubber body, in phantom.
Figure 4:
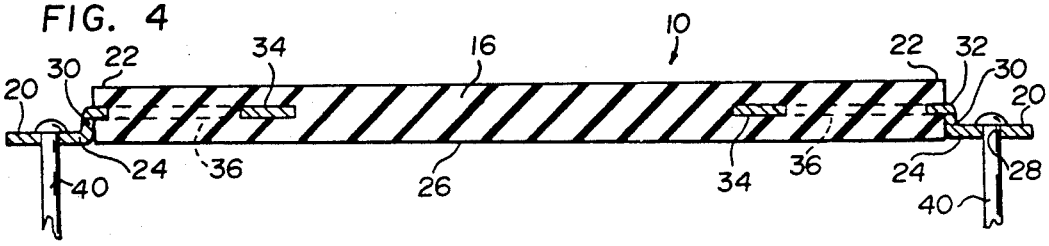
FIG. 4 is a longitudinal cross sectional view through the pitching rubber and is taken along line 4—4 of FIG. 3.

Referring now to the drawings in greater detail there is illustrated therein a pitching rubber 10 made in accordance with the teachings of the present invention.

As shown in FIG. 1, the pitching rubber 10 must be fixed to an underlying surface, usually a playing field, in a manner where positioning thereof remains secure as a pitcher's foot 12 exerts a pressure against a lateral edge 14 of the pitching rubber 10 during a pitch.

To accommodate placement of the foot 12 as shown against a body 16 of the pitching rubber it is proposed that the body 16 be of hard rubber and in the form of a rectangular block approximately ¾ inch thick. The width of the body 16 may be approximately 4 or 6 inches and the length may be 18 or 24 inches, as required by league rules.

The body 16 is created from hard rubber so as not to "give" when pressure is applied thereagainst.

To engage the body 16 of the pitching rubber 10 to an underlying surface, there are provided two end flanges 20, one at each longitudinal end 22 of the body 16.

Each end flange 20 comprises three planar sections, the first section 24 thereof extending laterally outwardly of the body 16 in a manner where the flange section 24 lies in the same plane as a bottom surface 26 of the body 16, creating an extension thereof.

This first section 24 is approximately 4 inches in length along the longitudinal end 22 of the rubber body 16 and extends to a width which can accommodate a bore 28 therein having a diameter of approximately 7/16 inch to accommodate a spike having a diameter of ⅜ inch.

A second section 30 of the flange 20 is perpendicular to the first section 24 and rises approximately half the thickness of the body 16 and rests therealong. This section tapers from approximately 4 inches in length at its juncture with the first section to approximately 2 inches at its upper extent 32.

The upper extent 32 of this second section 30 folds into a third section 34 which is perpendicular to the second section 30 and extends into the body 16 of the pitching rubber 10 approximately 2½ inches.

This third section 34 of the flange 20 has an opening 36 centered therein which extends laterally outwardly into the second section 30 so that continuity of the rubber body 16 is achieved along the longitudinal end 22 thereof.

The opening 36 is provided to assure secure engagement between the body 16 and the flange 20.

In this respect, during formation of the pitching rubber 10, the third section 34 of each flange 20 is seated appropriately within a mold which defines the body 16 of the pitching rubber 10.

Molten rubber is then poured into the mold, flowing around the third section 34 of the flange and filling the opening 36 in the section 34, trapping the flange section 34 in position, and creating a secure engagement therewith.

In use, the pitching rubber 10 is placed on the underlying surface, with the flange first sections 24 lying along the ground. A spike 40 is received within the bore 28 in each first flange section 24 and pounded into the ground, securing the pitching rubber 10 in appropriate position.

To remove the pitching rubber 10, one merely pries the spikes 40 out of the ground, taking them and the pitching rubber 10 to another field or position, as required.

This is extremely less time consuming than the manner presently available for securing and removing a pitching rubber, as desired.

The pitching rubber 10 of the present invention has a number of advantages, some of which have been described above and others of which are inherent in the invention.

Also modifications may be proposed to the pitching rubber 10 without departing from the teachings herein. Accordingly the scope of the invention is only to be limited as necessitated by the accompanying claims.

I claim:

1. A portable pitching rubber for use in playing ball comprising a block of hard rubber having mounting flanges engaged thereto, a section of each flange extending longitudinally from and lying against a surface underlying, the rubber block, said block being approximately ¾ inch high, and having a width between 3 inches and 7 inches and a length between 16 inches and 26 inches.

2. The pitching rubber of claim 1 wherein each flange is made of metal.

3. The pitching rubber of claim 2 wherein each flange has first, second and third planar sections.

4. The pitching rubber of claim 3 wherein a first section of said flange extends longitudinally from longitudinal ends of said rubber block and has a bore therethrough.

5. The pitching rubber of claim 4 wherein said bore is sized and configured to receive a spike therethrough.

6. The pitching rubber of claim 5 wherein a second section of flange is perpendicular to the first section, and extends upwardly along the longitudinal end of said rubber block to approximately half the height of said block.

7. The pitching rubber of claim 6 wherein said second section of each flange tapers upwardly.

8. The pitching rubber of claim 7 wherein a third section of said flange is perpendicular to said second section and extends into said rubber block a predetermined distance.

9. The pitching rubber of claim 8 wherein said third section of said flange has a centered, relatively large opening therein.

10. The pitching rubber of claim 9 wherein said opening is filled with the hard rubber of the block.

11. The pitching rubber of claim 10 wherein said opening extends to and cuts into a top surface of said second flange section.

12. The pitching rubber of claim 11 wherein the width and length of the block are 4 inches and 18 inches, respectively.

13. The pitching rubber of claim 11 wherein the width and length of the block are 6 inches and 24 inches, respectively.

14. The pitching rubber of claim 11 wherein said flange third section extends approximately 2½ inches into said rubber block.

15. The pitching rubber of claim 14 wherein said flange third section is approximately 2 inches wide.

16. The pitching rubber of claim 15 wherein said flange is centered along the width of said block.

17. The pitching rubber of claim 16 wherein said flange first section is approximately 4 inches long.

18. A portable pitching rubber for use in playing ball comprising a rectangular block of hard rubber having a flange mounted to each longitudinal end thereof, each flange including three sections, a first planar section extending outwardly of said block and being coplanar with one rectangular surface thereof, a second planar section perpendicular to said first section and rising along said longitudinal end of said block and a third planar section perpendicular to said second section and extending into said block, each first flange section having a bore therethrough, each third flange section having an opening therein, and each second section extending from said first section to said third section.

* * * * *